US010950109B1

(12) United States Patent
Kashyap

(10) Patent No.: US 10,950,109 B1
(45) Date of Patent: Mar. 16, 2021

(54) NOTIFICATION DEVICE FOR STOVES

(71) Applicant: Anish Kashyap, Fremont, CA (US)

(72) Inventor: Anish Kashyap, Fremont, CA (US)

( * ) Notice: Subject to any disclaimer, the term of this patent is extended or adjusted under 35 U.S.C. 154(b) by 0 days.

(21) Appl. No.: 16/680,877

(22) Filed: Nov. 12, 2019

(51) Int. Cl.

| | |
|---|---|
| ***G08B 21/00*** | (2006.01) |
| ***G08B 19/00*** | (2006.01) |
| ***G08B 17/10*** | (2006.01) |
| ***G08B 27/00*** | (2006.01) |
| ***G08B 21/18*** | (2006.01) |
| ***G08B 21/22*** | (2006.01) |

(52) U.S. Cl.
CPC ..... *G08B 19/00* (2013.01); *G08B 17/10* (2013.01); *G08B 21/182* (2013.01); *G08B 21/22* (2013.01); *G08B 27/005* (2013.01)

(58) Field of Classification Search
CPC ..... G08B 19/00; G08B 21/22; G08B 27/005; G08B 17/10; G08B 21/182; G05D 23/1951; G05D 23/1917; F24C 7/082; F24C 3/124; A47J 36/321; A47J 36/32; H04L 67/24; H04L 67/22; H04L 12/4625; H04L 12/1895; H04L 67/10; G05B 19/0428; G05B 19/042; G05B 2219/2613
USPC ..... 340/540, 632, 605, 588, 640
See application file for complete search history.

(56) References Cited

U.S. PATENT DOCUMENTS

| | | | | |
|---|---|---|---|---|
| 4,295,028 | A | 10/1981 | Tanabe | |
| 4,916,437 | A | 4/1990 | Gazzaz | |
| 4,930,488 | A | 6/1990 | Pearman et al. | |
| 5,446,445 | A | 8/1995 | Bloomfield et al. | |
| 5,608,378 | A | 3/1997 | McLean et al. | |
| 5,945,017 | A * | 8/1999 | Cheng | F23D 14/76 219/446.1 |
| 6,025,788 | A | 2/2000 | Diduck | |
| 6,053,810 | A | 4/2000 | Medina | |
| 6,164,958 | A | 12/2000 | Huang et al. | |
| 8,294,567 | B1 | 10/2012 | Stell | |
| 8,436,738 | B2 | 5/2013 | Bach et al. | |
| 9,752,783 | B2 | 9/2017 | Huang et al. | |
| 9,897,315 | B2 | 2/2018 | Nebbia et al. | |
| 2006/0191323 | A1 | 8/2006 | Garabedian et al. | |
| 2006/0202848 | A1 | 9/2006 | Volodarsky | |
| 2010/0330515 | A1 | 12/2010 | Ueki et al. | |
| 2012/0132635 | A1 * | 5/2012 | Mishra | F24C 7/083 219/209 |
| 2016/0035202 | A1 | 2/2016 | Chin | |
| 2017/0329358 | A1 * | 11/2017 | Ferguson | H04L 67/24 |

(Continued)

*Primary Examiner* — Anh V La
(74) *Attorney, Agent, or Firm* — Dunlap Bennett & Ludwig, PLLC; Brendan E. Squire

(57) ABSTRACT

A computing system includes a processor, a memory, and a wireless communication interface. At least one gas sensor is electrically coupled to the computing system and is configured to detect gas in an atmosphere. At least one temperature sensor is electrically coupled to the computing system and is configured to detect a level of temperature within the atmosphere. At least one motion sensor is electrically coupled to the computing system. The processor activates the at least one motion sensor when at least one of the at least one gas sensor detects a gas in the atmosphere and the at least one temperature sensor detects a temperature higher than a threshold temperature. The processor sends a notification to a remote computer via the wireless communication interface if the at least one motion sensor fails to detect a motion within a threshold period of time.

10 Claims, 3 Drawing Sheets

(56) References Cited

U.S. PATENT DOCUMENTS

| | | | | |
|---|---|---|---|---|
| 2018/0003392 | A1* | 1/2018 | Babu | H05B 1/0266 |
| 2018/0242772 | A1* | 8/2018 | Jenkins | A47J 36/321 |
| 2018/0253953 | A1* | 9/2018 | Bucsa | G08B 25/10 |
| 2019/0043332 | A1 | 2/2019 | Bublil | |

* cited by examiner

NOTIFICATION DEVICE FOR STOVES

BACKGROUND OF THE INVENTION

The present invention relates to stoves and, more particularly, to a notification device for gas leaks and unintentionally leaving a stove burner on.

Fuels such as propane and natural gas are commonly used in a variety of appliances such as e.g., stoves, ovens, dryers, and water heaters. Typically, such appliances are connected to a gas supply that may have hook-ups available at one or more locations within a dwelling or other structure. To enhance safety, it is desirable to determine whether any such appliance is leaking gas.

One of the most common ways fires start in residential homes is when the occupant leaves the building and forgets to turn off the stove. When left unattended, the heat generated by the burners melt the stove top and subsequently implode. In so doing, the areas surrounding the stove, such as wooden cabinets and kitchen utensils, catch fire and spread the conflagration.

As can be seen, there is a need for a notification device for gas leaks and unintentionally leaving a stone burner on.

SUMMARY OF THE INVENTION

In one aspect of the present invention, a notification device comprises: a computing system comprising a processor, a memory, and a wireless communication interface; at least one gas sensor electrically coupled to the computing system and configured to detect gas in an atmosphere; at least one temperature sensor electrically coupled to the computing system and configured to detect a level of temperature within the atmosphere; and at least one motion sensor electrically coupled to the computing system, wherein the processor activates the motion sensor when at least one of the at least one gas sensor detects a gas in the atmosphere and the at least one temperature sensor detects a temperature higher than a threshold temperature; and sends a notification to a remote computer via the wireless communication interface if the at least one motion sensor fails to detect a motion within a threshold period of time.

In another aspect of the present invention, a method of monitoring a stove comprises the steps of: providing a notification device comprising: a computing system comprising a processor, a memory, and a wireless communication interface; at least one gas sensor electrically coupled to the computing system and configured to detect gas in an atmosphere; at least one temperature sensor electrically coupled to the computing system and configured to detect a level of temperature within the atmosphere; and at least one motion sensor electrically coupled to the computing system, wherein the processor activates the motion sensor when at least one of the at least one gas sensor detects a gas in the atmosphere and the at least one temperature sensor detects a temperature higher than a threshold temperature; sends a notification to a remote computer via the wireless communication interface if the at least one motion sensor fails to detect a motion within a threshold period of time; and placing the notification device on to a stove.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
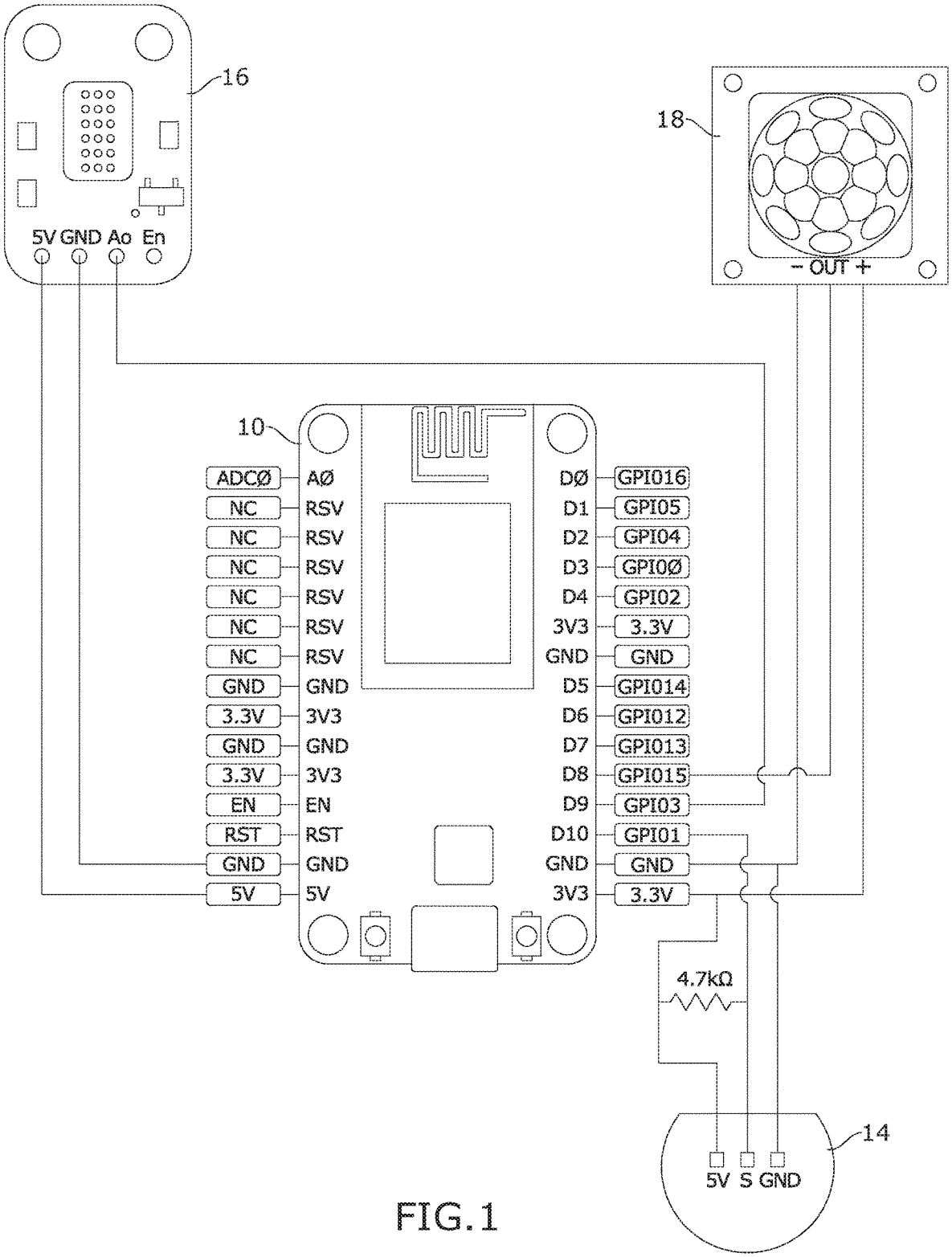
FIG. 1 is a schematic view of an embodiment of the present invention.
Figure 2:
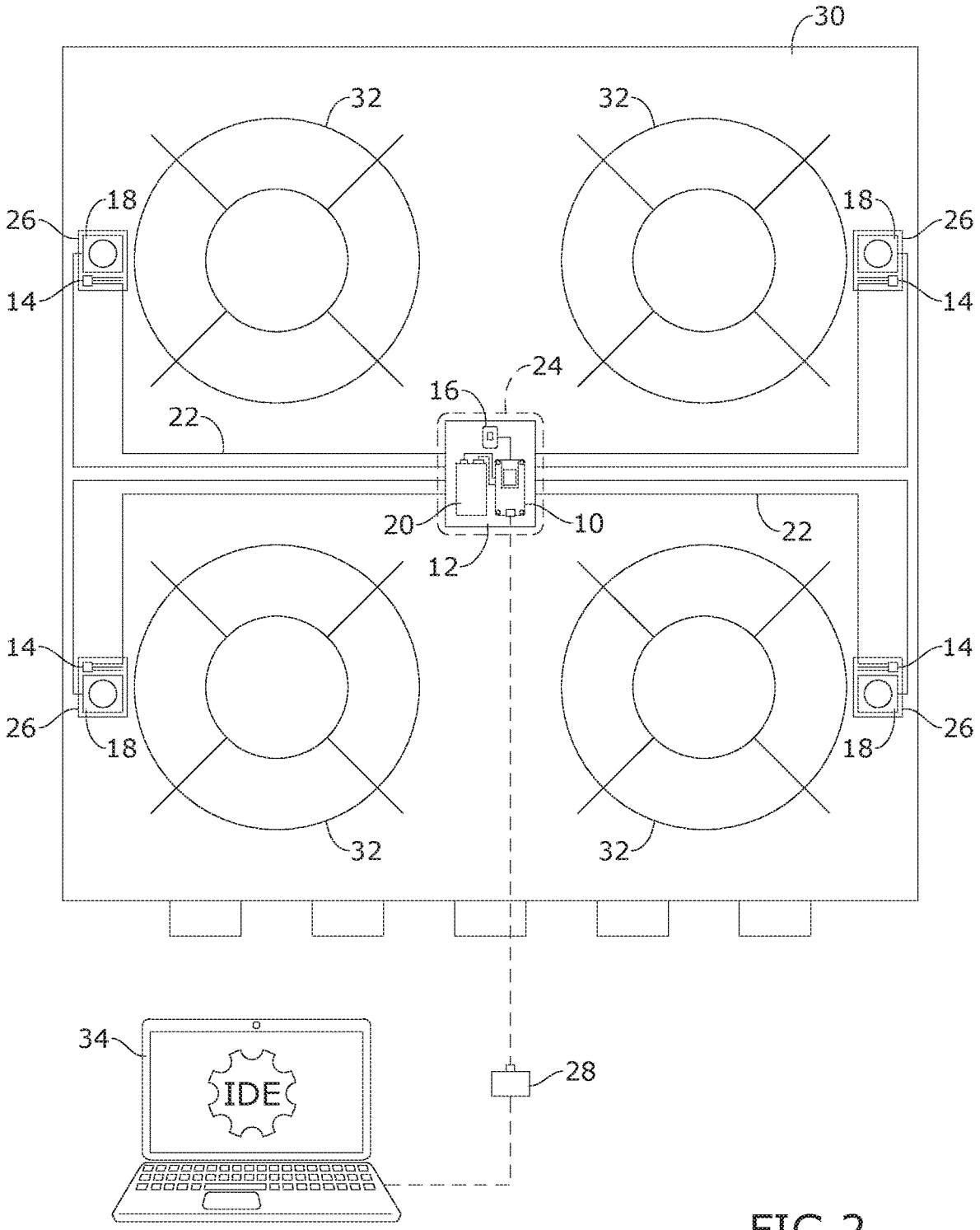
FIG. 2 is a schematic view of an embodiment of the present invention, installed on a stove.
Figure 3:
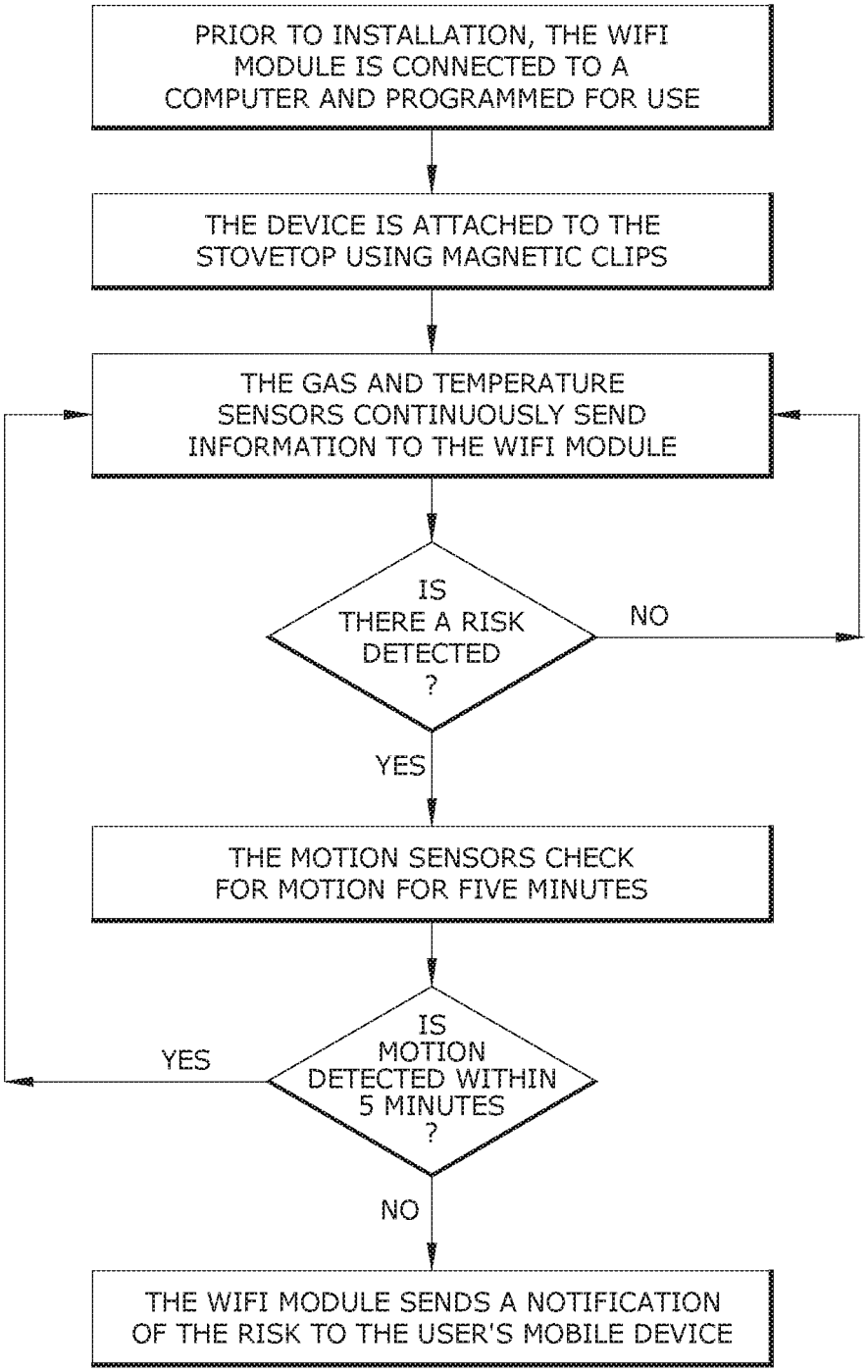
FIG. 3 is a flow chart of a method of an embodiment of the present invention.

Referring to FIGS. 1 and 3, the present invention includes a computing system 12 including a processor, a memory, and a wireless communication interface 10. At least one gas sensor 16 is electrically coupled to the computing system 12 and is configured to detect gas in an atmosphere. At least one temperature sensor 14 is electrically coupled to the computing system 12 and is configured to detect a level of temperature within the atmosphere. At least one motion sensor 18 is electrically coupled to the computing system 12. The processor activates the at least one motion sensor 18 when at least one of the at least one gas sensor 16 detects a gas in the atmosphere and the at least one temperature sensor 14 detects a temperature higher than a threshold temperature. The processor sends a notification to a remote computer 34 via the wireless communication interface 10 if the at least one motion sensor 18 fails to detect a motion within a threshold period of time.

In certain embodiments, the present invention includes a plurality of modules 24, 26. The plurality of modules 24, 26 may include a main module 24 and a plurality of sensor modules 26. The main module 24 may include the computing system 12, the at least one gas sensor 16, and a battery 20. The plurality of sensor modules 26 may each include one of the plurality of temperature sensors 14 and one of the plurality of motion sensors 14. The plurality of sensor modules 26 are electrically connected to the main module 24 by electrical wiring 22. Alternatively, the present invention may include a plurality of modules 24, 26 each having a computing system 12 with a wireless communications interface 10, a motion sensor 18, a temperature sensor 14, a gas sensor 16, and a battery 20. The modules 24, 26 may be magnetic to easily attached to a metal stove top 30 adjacent to burners 32.

The computing system 12 of the present invention may communicate with a remote computer 34. The remote computer 34 may include a desktop, laptop, console, or smart device, such as a smart phone and a tablet. In certain embodiments, a wireless USB adapter 28 may be used to wirelessly communicate with the computing system 12. Alternatively, the present invention may communicate over wiFi, Bluetooth™, or another wireless network. If used with a smart device, an application may be loaded on the smart device. When the computing system 12 detects a temperature above a certain threshold, such as 90 degrees to 120 degrees Fahrenheit, for longer than the threshold amount of time, such as about 3 minutes up to 7 minutes, such as 5 minutes, the computing system 12 sends a message to the smart device, which opens the application and enables a notification mechanism, such as sound and vibration.

An exemplary list of components of the present invention may include the following:

1. esp8266 wifi module
2. pcb board
3. Four ds18b20 temperature sensors
4. mics5524 gas sensor
5. Four PIR sensors
6. One 9V battery
8. electrical wiring
9. housing for computing system
10. usb to micro usb adaptor
12. Magnetic clips A method of monitoring a stove include the following steps: providing a notification device comprising: a computing system comprising a processor, a memory, and a wireless communication interface; at least one gas sensor electrically coupled to the computing system and configured to detect gas in an atmosphere; at least one temperature sensor electrically coupled to the computing system and configured to detect a level of temperature within the atmosphere; and at least one motion sensor electrically coupled to the computing system, wherein the processor activates the motion sensor when at least one of the at least one gas sensor detects a gas in the atmosphere and the at least one temperature sensor detects a temperature higher than a threshold temperature; sends a notification to a remote computer via the wireless communication interface if the at least one motion sensor fails to detect a motion within a threshold period of time; and placing the notification device on to a stove. Additionally, the method may include placing each of the plurality of sensor modules adjacent to a burner of the stove.

It should be understood, of course, that the foregoing relates to exemplary embodiments of the invention and that modifications may be made without departing from the spirit and scope of the invention as set forth in the following claims.

What is claimed is:

1. A notification device comprising:

a computing system comprising a processor, a memory, and a wireless communication interface;

at least one gas sensor electrically coupled to the computing system and configured to detect gas in an atmosphere;

at least one temperature sensor electrically coupled to the computing system and configured to detect a level of temperature within the atmosphere; and at least one motion sensor electrically coupled to the computing system, wherein the processor activates the motion sensor when at least one of the at least one gas sensor detects a gas in the atmosphere and the at least one temperature sensor detects a temperature higher than a threshold temperature; and sends a notification to a remote computer via the wireless communication interface if the at least one motion sensor fails to detect a motion within a threshold period of time; and a sensor module attached to a stove cooktop adjacent each burner of the stove cooktop, each sensor module housing one of the at least one temperature sensor and one of the at least one motion sensor monitor the temperature and motion at each burner.

2. The notification device of claim 1, further comprising a magnet coupled to the sensor module the magnet configured to mount the sensor module to the stove cooktop.

3. The notification device of claim 2, wherein the at least one temperature sensor is a plurality of temperature sensors and the at least one motion sensor is a plurality of motion sensors.

4. The notification device of claim 3, wherein the at least one module comprises a plurality of modules comprising a main module and a plurality of sensor modules, wherein the main module comprises the computing system and the at least one gas sensor capable of detecting each of a carbon monoxide and a natural gas, and the plurality of sensor modules each comprise one of the at least one programmable limit temperature sensors and one of the plurality of motion sensors, wherein the plurality of sensor modules are electrically connected to the main module by electrical wiring.

5. A method of monitoring a stove comprising the steps of:

providing a notification device comprising:

a computing system comprising a processor, a memory, and a wireless communication interface;

at least one gas sensor electrically coupled to the computing system and configured to detect gas in an atmosphere;

at least one temperature sensor electrically coupled to the computing system and configured to detect a level of temperature within the atmosphere; and at least one motion sensor electrically coupled to the computing system, wherein the processor activates the motion sensor when at least one of the at least one gas sensor detects a gas in the atmosphere and the at least one temperature sensor detects a temperature higher than a threshold temperature;

sends a notification to a remote computer via the wireless communication interface if the at least one motion sensor fails to detect a motion within a threshold period of time; and placing the notification device on to a stove and a sensor module mounted adjacent each burner of a cooktop of the stove, each sensor module housing one of the at least one temperature sensor and one of the at least one motion sensor.

6. The method of claim 5, wherein the notification device further comprises a magnet coupled to each sensor module for mounting the sensor module to the cooktop of the stove.

7. The method of claim 5, wherein the at least one temperature sensor is a plurality of temperature sensors, and the at least one motion sensor is a plurality of motion sensors.

8. The method of claim 7, wherein the notification device comprises a plurality of modules comprising a main module and a plurality of the sensor modules, wherein the main module comprises the computing system and the at least one gas sensor, and the plurality of sensor modules each comprise one of the plurality of temperature sensors and one of the plurality of motion sensors, wherein the plurality of sensor modules are electrically connected to the main module by electrical wiring.

9. The method of claim 8, further comprising the step of placing each of the plurality of sensor modules adjacent to a burner of the stove.

10. A notification device consisting of:

a main module having a computing system comprising a processor, a memory, a battery power source, a wireless communication interface, and at least one gas sensor configured to detect one of a carbon monoxide and a natural gas, the main module configured to attached to a cooktop of a stove;

a sensor module electrically coupled to the computing system, the sensor module having at least one programmable limit temperature sensor configured to detect a programmed level of temperature within the atmosphere, and a passive infrared motion sensor, each sensor module configured to be magnetically mounted to the cooktop adjacent to a burner of the stove;

the processor configured to activate the passive infrared motion sensor when the gas sensor detects carbon monoxide or the natural gas in the atmosphere and the at least one programmable temperature sensor detects a temperature higher than a threshold temperature; and the processor is configured to send a notification to a remote computer via the wireless communication interface when the passive infrared motion sensor fails to detect a motion within a threshold period of time.

* * * * *